United States Patent [19]

Legille et al.

[11] 4,306,828

[45] Dec. 22, 1981

[54] COMBINED FLOW CONTROL AND ISOLATION VALVE

[75] Inventors: Edouard Legille; Romain Frieden, both of Luxembourg, Luxembourg

[73] Assignee: Paul Wurth S.A., Luxembourg, Luxembourg

[21] Appl. No.: 64,786

[22] Filed: Aug. 8, 1979

[30] Foreign Application Priority Data

Aug. 16, 1978 [LU] Luxembourg ..... 80113

[51] Int. Cl.[3] ..... F27B 1/20

[52] U.S. Cl. ..... 414/199; 222/558; 251/158; 251/204

[58] Field of Search ..... 414/167, 169, 199, 200, 414/208; 266/176, 184; 222/558; 251/158, 204

[56] References Cited

U.S. PATENT DOCUMENTS 1,987,746 1/1935 McNulty ..... 251/158

4,074,835 2/1978 Legille et al. ..... 222/558

*Primary Examiner*—Robert G. Sheridan

*Attorney, Agent, or Firm*—Fishman and Van Kirk

[57] ABSTRACT

An isolation and flow control valve in a furnace charging installation, installed in a discharge conduit of a storage hopper which may be alternately at ambient pressure for loading and furnace pressure for discharging, is characterized by a valve member which is caused to move serially in two directions during opening and closing. The movement is produced by an actuator mechanism including a pivot arm and a cam system and results in movement axially with respect to the conduit for seating and unseating and generally transverse to the conduit axis for controlling material flow through the conduit.

14 Claims, 4 Drawing Figures

COMBINED FLOW CONTROL AND ISOLATION VALVE

BACKGROUND OF THE INVENTION (1) Field of the Invention

The present invention relates to the charging of blast furnaces and particularly to the exercise of control over the flow of material from a pressurized storage hopper into a furnace. More specifically, this invention is directed to apparatus for performing the dual functions of establishing a hermetic seal in and controlling the flow of material through a conduit such as for, example, a channel via which particulate matter is delivered to the interior of a pressurized furnace. Accordingly, the general objects of the present invention are to provide novel and improved methods and apparatus of such character.

(2) Description of the Prior Art

While not limited thereto in its utility, the present invention is particularly well suited for use in a shaft furnace charging installation of the "bell-less" top type as disclosed in U.S. Pat. No. 3,693,812. In this type of charging installation the furnace is provided with one or more intermediate storage hoppers which may be alternately opened to the ambient atmosphere for loading material therefrom to the interior of the pressurized furnace via a tubular discharge channel. Such furnace charging installations, as exemplified by the disclosure of U.S. Pat. No. 4,074,835, employ a pair of serially arranged "valves" between the storage hopper and the furnace. The first or upper "valve" performs a material flow control or metering function, by increasing or reducing the area of the storage hopper discharge opening and thereby assists in the achievement of a desired distribution of material on the furnace hearth. The second or lower "valve" functions to establish the hermetic seal required to permit the alternate pressurizing and depressurizing of the storage hopper. In the prior art the metering "valve," by the very nature of its function, was designed to be moved in a substantially perpendicular direction in relation to the discharge channel and could not establish a hermetic seal. The sealing valve, on the other hand, was designed and actuated so that it could not perform a material flow control function.

The requirement for a pair of serially arranged "valves," as described above, increases the cost and complexity of a blast furnace charging installation. In some instances, particularly in the case of low and medium capacity furnaces, these additional costs are deemed significant. Accordingly, there has been a desire in the art to provide a single device which could perform the dual functions of metering the flow of granular material flowing through a conduit and establishing a hermetic seal across the conduit while maintaining the high degree of reliability which has characterized installations wherein these functions were performed by separate "valves."

SUMMARY OF THE INVENTION

The present invention overcomes the above-briefly discussed and other deficiencies and disadvantages of the prior art by providing a novel material flow control and isolating device, particularly well suited for use in a furnace charging installation, wherein a single valve member is employed between a storage chamber and the equipment which receives material released from such storage chamber.

Apparatus in accordance with the present invention includes a single moveable valve member. This valve member has a surface which cooperates with a valve seat carried by a tubular discharge channel to hermetically seal the interior of the channel from the environment downstream of the valve member. This valve member serves both as a sealing or isolation device and as a metering or flow regulating device according to whether it occupies the closed position or some intermediate position between the full open and full closed positions. Apparatus in accordance with the present invention also includes an actuating system for the valve member which generates a compound movement of the valve member. In the preferred embodiment this motion has components in directions which are generally transverse to and along the axis of the discharge channel. During the movement in the generally transverse direction the valve member will be spaced a predetermined distance along the discharge channel axis from a valve seat defining portion of the channel. Thus, during a closing sequence the valve member will be actuated in a first direction to the position commensurate with the flow of material through the channel being terminated. The valve member will then be moved, the motion being substantially continuous, in a second and generally transverse direction to establish a hermetic seal to thereby isolate the interior of the channel upstream of the valve member from the interior of the furnace or other apparatus to which material is being delivered via the channel. In the opening direction the movement of the valve member is in the opposite direction; i.e., the valve member will move in a first direction to break the hermetic seal and then in a second and generally transverse direction to meter the flow of material.

In accordance with one embodiment of the present invention, the actuating mechanism for the valve member defines a support "cradle" for the valve member during the time it is functioning to control flow.

Also in accordance with the present invention, motion is delivered to the valve member via a pivot arm and the connection between the arm and valve member may include a pivot which slides in a camming slot to produce the motion toward and away from the valve seat.

In accordance with one embodiment of the present invention, the connection between the pivot arm and valve member comprises an extension of the pivot arm, the arm extension being generally transverse to the remainder of the pivot arm, which has a pair of integral flanges which are provided with slanting oblong holes. These holes are engaged by the cross bar of a T-shaped pivot which is affixed to the valve member.

In the embodiment of the present invention wherein the connection between the valve member and the pivot arm defines a support "cradle," means are preferably provided to adjust the spacing between the valve member and such "cradle."

In accordance with another embodiment of the present invention, a cam system is incorporated in the connection between the valve actuating pivot arm and its drive shaft and this cam system causes the two generally transverse directions of motion of the valve member in response to rotation of the said drive shaft.

In accordance with the present invention it is advantageous for the valve member to have the shape of a cylindrical cap and for the discharge channel with which the valve member cooperates to have a polygonal cross-section which approximates an ovoid shape.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENTS

Figure 1:
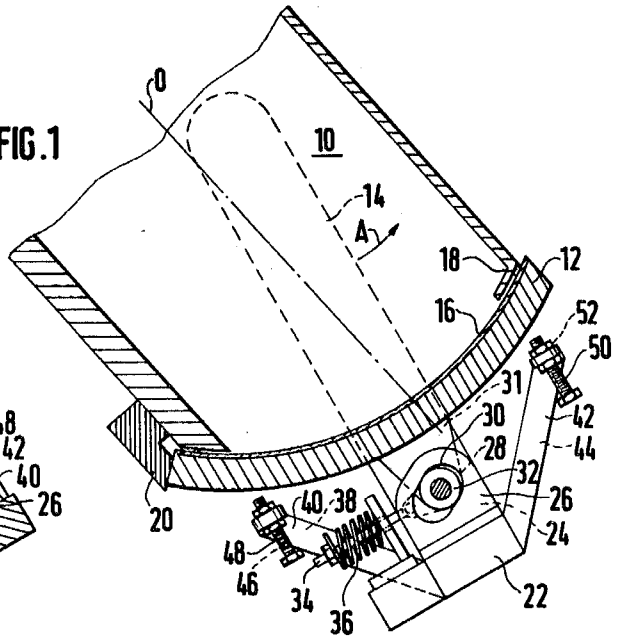
FIG. 1 is a schematic, cross-sectional side elevation view of apparatus in accordance with a first embodiment of the present invention.
Figure 2:
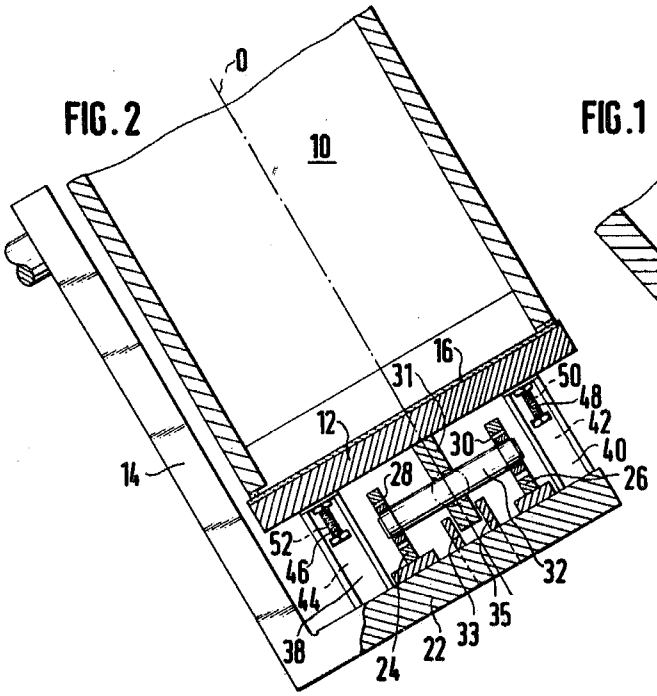
FIG. 2 is a cross-sectional view of the apparatus of FIG. 1 taken in a direction transverse to the FIG. 1 showing.

Referring jointly to FIGS. 1 and 2, a tubular member, which may be the discharge channel associated with an intermediate storage hopper of a furnace charging installation, is indicated at 10. It will be understood that channel 10 is hermetically coupled at its upper end, as the apparatus is shown in the drawing, to a storage hopper or other container which may be alternately pressurized and depressurized. Considering a furnace charging installation, isolation of the interior of channel 10, at the lower end thereof, from the interior of a furnace and the control of the flow of material moving through channel 10 under the influence of gravity is accomplished by a valve member 12 which cooperates with a valve seat 18 defined by the said lower end of channel 10. Channel 10 has a longitudinal axis "O" and preferably has a polygonal cross section which approximates an ovoid shape.

The valve member 12 is coupled to a pivot arm 14 which, in turn, is mounted on a rotatable drive shaft. Rotation of this drive shaft is caused by means of a hydraulic motor, not shown in the drawing, in such a way as to move valve member 12 over a path corresponding to its curvature between the closed position, shown in FIG. 1, and any desired open position whereby valve member 12 will define a variable area discharge opening at the bottom of channel 10.

In order to insure a hermetic seal between valve member 12 and the bottom of channel 10, whereby the valve member may function as an isolation valve for the interior of channel 10, valve member 12 is provided on its internal surface, at least in the peripheral region, with a layer 16 of a material suitable for the production of a hermetic closure. Channel 10 is provided, on its exterior, with at least a first "shoe" 20 which functions as a stop to limit the movement of valve 12 in the closing direction. "Shoe" 20 stops the movement of valve member 12, in a direction generally transverse to axis "O" of channel 10, when the valve member is in an orientation which will insure the ability to establish a hermetic seal between the surface layer 16 of valve member 12 and the valve seat 18.

The pivot arm 14 is provided, at its free end, with a transversely extending extension 22. Transverse arm extension 22 has, affixed thereto, a pair of flanges 24 and 26 which extend generally parallel to the pivot arm 14. As may best be seen from FIG. 1, flanges 24 and 26 are respectively provided with cam slots defined by oblong holes 28 and 30. The slots 28 and 30 receive the opposite ends of the cross bar 32 of a T-shaped pivot; the base 31 of the pivot being affixed to and extending outwardly from the valve member 12. The slots 28 and 30 are sized and oriented such that the pivot bar 32 may slide therein; i.e., the minor axis of slots 28 and 30 is approximately equal to the diameter of pivot bar 32, the major axis of the holes is greater than the diameter of pivot bar 32 and the slots are slanted with respect to pivot arm 14. The pivot bar 32 is additionally connected to the transverse extension 22 of pivot arm 14 by means of a threaded rod 34 and a spring 36. For reasons which will become obvious from the discussion below, the bias exerted on pivot bar 32 by spring 36 is adjustable.

The transverse extension 22 of pivot arm 14 is also provided with four outwardly and upwardly extending feet 38, 40, 42 and 44, feet 38 and 44 not being visible in the drawing, designed to form a support for valve member 12 when the valve member moves away from the seat 18. The clearance between this support and the valve member, with the valve in the closed position shown, may be adjusted by means of screws 46, 48, 50 and 52, adjusting screws 52 and 46 not being visible in the drawing. While the four adjusting screws have been shown as mounted on respective of the feet, it will be understood that the adjusting screws may be mounted on valve member 12.

FIG. 1, as previously noted, shows the apparatus with the valve member 12 urged tightly against valve seat 18 to establish a hermetic seal and to isolate the interior of channel 10 from the environment downstream of the valve. When pivot arm 14 is actuated in the direction indicated by the arrow "A," the pivot bar 32 will initially move in a direction defined by the cam slots 28 and 30. During this initial phase of the valve-opening sequence, the pivot bar 32 will slide, under the influence of spring 36 and possibly also under the influence of the weight of valve member 12, toward the most downstream end of slots 28 and 30. This downward movement of pivot 32 causes the valve member 12 to become unseated. During unseating, the valve member 12 will move generally in the downstream direction; i.e., along the channel axis; a distance which is proportional to the length of the relative movement between pivot bar 32 and the slots 28 and 30.

When pivot bar 32 reaches the limit of motion toward the base of the slots 28 and 30, presuming that pivot arm 14 continues to move in the direction of arrow "A," valve member 12 and pivot arm 14 will begin to move simultaneously in the counterclockwise direction, as the apparatus is shown in FIG. 1, whereby the lower end of channel 10 will be progressively opened so as to permit material to flow through the channel. Thus, it may be seen that an opening sequence in accordance with the present invention includes an initial phase wherein the valve member moves in a first direction away from the valve seat followed by a second phase where the valve member is moved in a direction generally transverse to the channel axis to define a material flow opening which increases in area as the valve member movement continues.

The closing of the valve will, of course, consist of the same two phases as discussed above performed in the reverse order. During the closing of the flow opening the valve member 12 is pivoted with pivot arm 14 in the direction opposite to that indicated by arrow "A." During this motion the pivot bar 32 is held, by the bias of spring 36 and possibly also because of the weight of valve member 12, at its most downward position toward the base of the guide slots 24 and 26; i.e., the pivot bar 32 is in the opposite position to that shown in FIG. 1. The first phase of the closing sequence terminates when the valve member 12 contacts the "shoe" 20. At this time the valve member will be in a closed but non-hermetic position. Once the valve member 12 contacts "shoe" 20 it is stopped from further movement in the direction in which arm 14 is pivoting. The arm 14, however, continues to rotate and this continued motion causes pivot bar 32 to ride up cam slots 24 and 26 to the position shown in FIG. 1 in opposition to the bias of spring 36. The relative movement between pivot bar 32 and slots 28 and 30 results in valve member 12 moving longitudinally with respect to channel axis "O" and firmly seats the valve member 12 against valve seat 18 to thus isolate the interior of channel 10 from the downstream equipment.

The amplitude of the longitudinal movement which occurs when the valve member 12 separates from seat 18 is a function of the length of slots 28 and 30 and the position of the adjusting screws 46, 48, 50 and 52. In actual practice, the longitudinal movement of the valve member will be determined by the adjusting screws 46, 48, 50, and 52 and the valve member 12 will thus be supported on the feet 38, 40, 42 and 44 when in the unseated condition rather than on the lower ends of slots 28 and 30. When supported on feet 38, 40, 42 and 44 the valve member will not be subject to any play when it is performing its function as a flow control device.

Figure 3:
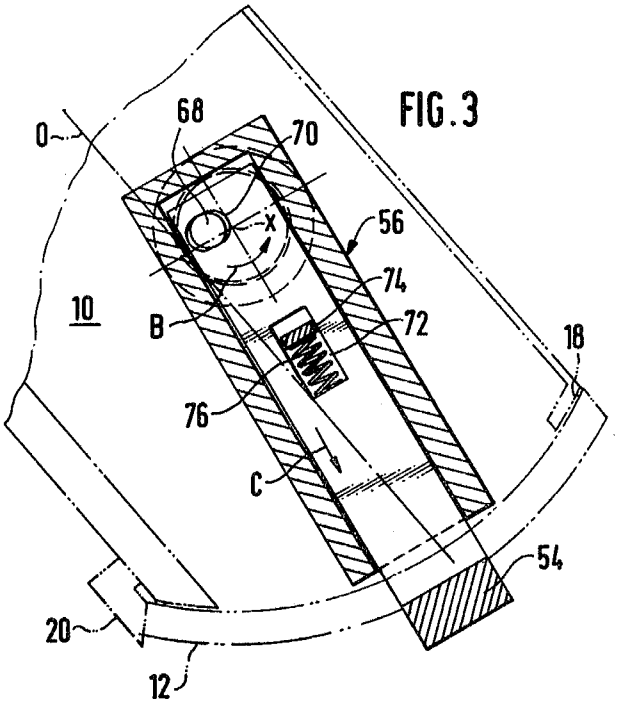
FIG. 3 is a schematic, cross-sectional side elevation view of apparatus in accordance with a second embodiment of the present invention.
Figure 4:
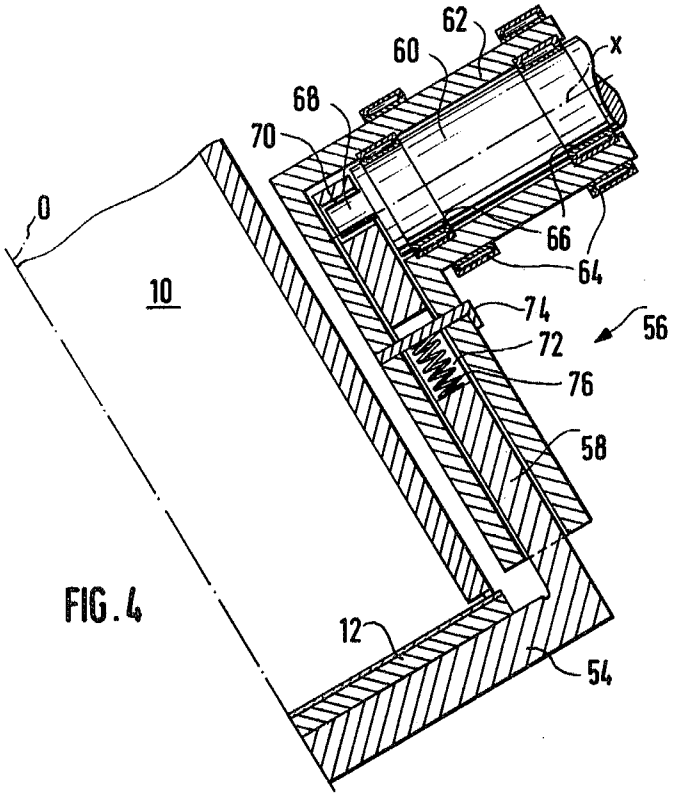
FIG. 4 is a view of the apparatus of FIG. 3 taken in a direction transverse to the FIG. 3 showing.

Referring now to the FIGS. 3 and 4, a second embodiment of the present invention is disclosed. This second embodiment operates in the same manner as the above-described embodiment of FIGS. 1 and 2. In the embodiment of FIGS. 3 and 4, however, the cam system which produces the two successive phases of generally transverse movement of the valve member is incorporated in the pivot arm; i.e., in the driving mechanism indicated generally at 56; for valve member 12. Thus, referring to FIGS. 3 and 4, the valve member 12 is directly affixed to a transverse extension 54 of the pivot arm 58. The source of power for moving the valve member comprises a motor, not shown, coupled to a rotary drive shaft 60 having a longitudinal axis "X." Both pivot arm 58 and drive shaft 60 are received in an L-shaped casing 62 as best shown in FIG. 4. A pair of bearings 64 supports casing 62 such that the entire drive mechanism 56 may pivot about axis "X." Relative rotational motion between drive shaft 60 and casing 62 is permitted by a second pair of bearings 66. An extension 68 of drive shaft 60 is offset with relation to axis "X" and thus functions as an eccentric cam. This eccentric cam 68 engages a hole 70, having a slightly oblong shape, provided in the upper end of pivot arm 58. Pivot arm 58 is also provided, intermediate the hole 70 and transverse extension 54, with a substantially rectangularly shaped second hole or opening 72. A pin 74 is captured in casing 62 and extends through opening 72 in pivot arm 58. A spring 76 is positioned within opening 72 between pin 74 and the lower end of the opening. Spring 76 biases the pivot arm 58 such that the transverse extension 54 thereof tends to move away from the pivot axis "X." The maximum amount of movement along the axis "O" of channel 10 of valve member 12 is determined by the spacing between pin 74 and the upper end of hole 72 in pivot arm 58.

In operation of the embodiment of FIGS. 3 and 4, drive shaft 60 will be rotated about its axis "X" in the direction shown by arrow "B." During rotation of shaft 60 the eccentric cam 68 performs a gyratory movement about axis "X." If the pin 74 were not present, and there were therefore no connection between the pivot arm 58 and casing 62, the gyratory movement of eccentric cam 68 would cause an alternating sliding movement of pivot arm 58 in relation to casing 62. Thus, without pin 74, casing 62 would remain motionless and the valve member 12 would not be moved transversely to open the lower end of channel 10. The pin 74 blocks the relative movement between casing 62 and pivot arm 58 after a predetermined initial amount of such movement during which the valve is unseated. Restated, the pivot arm 58 will, because of the engagement of eccentric cam 68 in hole 70, initially move downwardly during rotation of drive shaft 60 thus unseating the valve. When the top of the hole 72 in arm 58 contacts pin 74 further relative motion between pivot arm and casing 62 will be stopped and the continued rotation of drive shaft 60 will be translated into pivotal motion of the entire assembly 56 about axis "X."

In the embodiment of FIGS. 3 and 4, the closing sequence is opposite to the opening sequences described above and thus consists of a first transverse movement phase followed by a longitudinal phase during which the valve is seated. During the closing down of the opening at the bottom of channel 10 the pivot arm 58 remains in a "disengaged" position with the upper end of opening 72 in contact with pin 74 under the influence of spring 76 and the weight of valve member 12. When valve member 12 contacts the "shoe" 20, during the closing movement, the transverse phase of the movement of valve 12 is terminated and the longitudinal phase of the movement commences. During this longitudinal movement, the drive shaft 60 will be rotating in the opposite direction to that indicated by arrow "B" and pivot arm 58 will slide in casing 62 in opposition to the action of spring 76. The invention is operable without the inclusion of spring 76 since the combined weight of valve member 12, transverse extension 54 and arm 58 would be sufficient to insure unseating of the valve. The spring 76 is, however, preferred to provide a supplementary positive opening force.

It should also be noted that a pivoting connection, preferably an adjustable connection, may be employed between the transverse pivot arm extension 54 and valve member 12 in the embodiment of FIGS. 3 and 4 in order to insure seating of the valve in the case of deformation of components of the assembly.

As will now be obvious to those skilled in the art, the present invention comprises a drive mechanism for a valve member which generates two different movements; i.e., a generally axial or longitudinal movement, serving to establish or interrupt a hermetic seal, and a generally transversal movement, which defines an opening of adjustable area.

While preferred embodiments have been shown and described, various modifications and substitutions may be made thereto without departing from the spirit and scope of the invention. For example, in the FIG. 1 embodiment the flanges 24 and 26 could be on the valve member and the pivot bar on the arm 22 instead of the opposite arrangement which has been shown. Thus, it will be understood that the present invention has been described by way of illustration and not limitation.

What is claimed is:

1. In a furnace charging installation, the installation including a container which may be supplied with material to be delivered to the furnace interior and subsequently isolated from the ambient environment, the installation further including a conduit having an axis by means of which material may be delivered from the container to the furnace, an improved apparatus for controlling the flow of material through the conduit and for establishing a seal across the conduit to isolate the container from the furnace comprising:

a moveable valve member, said valve member having a sealing surface which cooperates with a peripheral valve seat on the conduit in the closed position to establish a seal across the conduit; and actuator means for said valve member, said actuator means causing said valve member to move between the closed position and a selected open position commensurate with a desired material flow rate through the conduit, said actuator means serially imparting motion in two directions to said valve member whereby, in an opening sequence, the valve member is moved in a first direction generally longitudinally with respect to the conduit axis to unseat the valve member and subsequently in a second direction to define with the conduit a discharge opening which increases in size as the movement in the second direction continues, said actuator means comprising:

pivot arm means;

means for causing said pivot arm means to rotate about a pivot axis; and cam means, said cam means coupling said pivot arm means to said valve member, said cam means producing said two directions of motion in response to rotation of said pivot arm means.

2. The apparatus of claim 1 wherein said cam means comprises:

a transverse extension of said pivot arm means; and means cooperating with said arm means extension to limit the motion of the valve member in said first direction.

3. The apparatus of claim 2 wherein said cam means further comprises:

flange means, said flange means being provided with at least a first cam slot, said slot having an angular relationship to the conduit axis; and pivot means, said pivot means having a pivot bar engaging said slot, said flange means and pivot means coupling said arm means extension to said valve member and movement of said bar in said slot causing said motion in the first direction.

4. The apparatus of claim 3 wherein the means limiting motion of the valve member in the first direction comprises:

means defining a support for said valve member when in an open position, said support means being integral with said arm means extension, said valve member contacting said support means at its limit of motion in said first direction; and means for adjusting the spacing between said valve member and said support means with said valve means in the seated position.

5. The apparatus of claim 3 wherein said flange means is integral with said arm means extension and comprises a pair of spaced flanges, each of said flanges having a cam slot therein, and wherein said pivot means comprises a T-shaped pivot integral with said valve member, the cross-bar of said pivot comprising said pivot bar and engaging said cam slots.

6. The apparatus of claim 5 wherein the means limiting motion of the valve member in the first direction comprises:

means defining a support for said valve member when in an open position, said support means being integral with said arm means extension, said valve member contacting said support means at its limit of motion in said first direction; and means for adjusting the spacing between said valve member and said support means with said valve means in the seated position.

7. The apparatus of claim 2 further comprising:

means resiliently biasing said valve member in said first direction.

8. The apparatus of claim 2 further comprising:

stop means mounted on the conduit, said stop means limiting the motion of said valve member in a direction opposite to said second direction during a closing sequence.

9. The apparatus of claim 8 further comprising:

means resiliently biasing said valve member in said first direction.

10. The apparatus of claim 8 wherein said valve member is provided with a surface layer which enhances the seal established with the seat.

11. The apparatus of claim 10 further comprising:

means resiliently biasing said valve member in said first direction.

12. In a furnace charging installation, the installation including a container which may be supplied with material to be delivered to the furnace interior and subsequently isolated from the ambient environment, the installation further including a conduit having an axis by means of which material may be delivered from the container to the furnace, an improved apparatus for controlling the flow of material through the conduit and for establishing a seal across the conduit to isolate the container from the furnace comprising:

a moveable valve member, said valve member having a sealing surface which cooperates with a peripheral valve seat on the conduit in the closed position to establish the seal across the conduit; and actuator means for said valve member, said actuator means causing said valve member to move between the closed position and a selected open position commensurate with a desired material flow rate through the conduit, said actuator means serially imparting motion in two directions to said valve member whereby, in an opening sequence, the valve member is moved in a first direction generally longitudinally with respect to the conduit axis to unseat the valve member and subsequently in a second direction to define with the conduit a discharge opening which increases in size as the movement in the second direction continues, said actuator means comprising:

pivot arm means, said pivot arm means being coupled to said valve member;

means for causing said pivot arm means to rotate about a pivot axis; and cam means, said cam means coupling said pivot arm means to said means for causing said pivot arm means to rotate, said cam means imparting serially two directions of motion to at least a portion of said pivot arm means.

13. The apparatus of claim 12 wherein said cam means further comprises:

a telescoping extension of said pivot arm means, said telescoping extension having a cam slot and a guide slot therein and being integral with said arm means extension at a first end;

bearing means, said bearing means permitting said pivot arm means to rotate with and relative to said rotation causing means;

a cam, said cam being off-set relative to said pivot axis and being driven by said rotation causing means, said cam engaging said cam slot in said telescoping extension of said pivot arm means and causing relative longitudinal motion between said pivot arm means and its extension in response to rotation of said rotation causing means; and pin means fixed to said pivot arm means, said pin means engaging said guide slot in said telescoping extension and limiting the relative motion between said extension and said pivot arm means, said relative motion corresponding to motion of said valve member in the first direction.

14. The apparatus of claim 13 further comprising:

means resiliently biasing said telescoping extension in said first direction.

* * * * *